US012735973B2

(12) United States Patent
Neufeldt

(10) Patent No.: US 12,735,973 B2
(45) Date of Patent: Sep. 15, 2026

(54) CONTROLLING DRILLING OF A WELLBORE BASED ON UPDATED BIT DEPTH

(71) Applicant: Pason Systems Corp., Calgary (CA)

(72) Inventor: Adam Chase Neufeldt, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 0 days.

(21) Appl. No.: 18/990,656

(22) Filed: Dec. 20, 2024

(65) Prior Publication Data

US 2026/0176953 A1 Jun. 25, 2026

(51) Int. Cl.
*E21B 44/00* (2006.01)

(52) U.S. Cl.
CPC ..... *E21B 44/00* (2013.01)

(58) Field of Classification Search
CPC ..... E21B 44/00
See application file for complete search history.

(56) References Cited

U.S. PATENT DOCUMENTS

| | | | |
|---|---|---|---|
| 6,050,348 | A | 4/2000 | Richardson et al. |
| 6,918,453 | B2 | 7/2005 | Haci et al. |
| 7,096,979 | B2 | 8/2006 | Haci et al. |
| 7,139,689 | B2 | 11/2006 | Huang |
| 7,152,696 | B2 | 12/2006 | Jones |
| 7,588,099 | B2 | 9/2009 | Kracik |
| 7,823,655 | B2 | 11/2010 | Boone et al. |
| 10,036,678 | B2 | 7/2018 | Fisher et al. |
| 10,190,402 | B2 | 1/2019 | Dykstra et al. |
| 10,214,964 | B2 | 2/2019 | Hornblower et al. |
| 10,358,904 | B2 | 7/2019 | Kyllingstad |
| 10,533,409 | B2 | 1/2020 | Benson et al. |
| 10,612,307 | B2 | 4/2020 | Summers et al. |
| 10,731,453 | B2 | 8/2020 | Groover et al. |
| 10,830,033 | B2 | 11/2020 | Weideman et al. |
| 10,883,356 | B2 | 1/2021 | Jeffryes et al. |
| 10,954,733 | B2 | 3/2021 | Chiam et al. |

(Continued)

FOREIGN PATENT DOCUMENTS

| | | |
|---|---|---|
| CA | 2525382 | 11/2004 |
| CA | 2525371 | 12/2004 |

(Continued)

OTHER PUBLICATIONS

SPE 167141—Practical Directional Drilling Techniques in Pinedale Field Wyoming To Improve Drilling Performance, Guangzhi Han, Lane Lemesany, Azar A. Azizov, Frank DeLeon, all Baker Hughes; Nov. 2013.

(Continued)

*Primary Examiner* — Giovanna Wright
(74) *Attorney, Agent, or Firm* — D'Ambrosio & Menon, PLLC; Usha Menon

(57) ABSTRACT

There is described a method of using one or more computer processors to control drilling of a wellbore. A current bit depth indicative of a depth of a drill bit being used to drill the wellbore is determined. A compression factor indicative of compression of a drill string to which is attached the drill bit is determined. Based on the current bit depth and the compression factor, the current bit depth is updated. The drilling of the wellbore is controlled based on the updated bit depth.

20 Claims, 10 Drawing Sheets

(56) References Cited

U.S. PATENT DOCUMENTS

| | | | | |
|---|---|---|---|---|
| 10,954,773 | B2 | 3/2021 | Benson et al. | |
| 11,143,011 | B2 | 10/2021 | Boone et al. | |
| 11,421,520 | B2 | 8/2022 | Zaripov | |
| 11,549,357 | B2 | 1/2023 | Neufeldt et al. | |
| 11,802,473 | B2 | 10/2023 | Neufeldt et al. | |
| 2002/0104685 | A1 | 8/2002 | Pinckard et al. | |
| 2004/0211596 | A1 | 10/2004 | Huang | |
| 2005/0060096 | A1* | 3/2005 | Hutchinson | E21B 44/00 702/6 |
| 2011/0102188 | A1* | 5/2011 | Mehta | E21B 47/007 340/854.1 |
| 2015/0377004 | A1 | 12/2015 | Hornblower et al. | |
| 2017/0037722 | A1 | 2/2017 | Jeffryes et al. | |
| 2017/0306702 | A1 | 10/2017 | Summers et al. | |
| 2019/0048707 | A1 | 2/2019 | Benson et al. | |
| 2019/0218901 | A1 | 7/2019 | Groover et al. | |
| 2019/0330968 | A1 | 10/2019 | Boone et al. | |
| 2020/0063546 | A1 | 2/2020 | Weideman et al. | |
| 2020/0165913 | A1 | 5/2020 | Benson et al. | |
| 2020/0355063 | A1* | 11/2020 | Van Vliet | G06F 17/40 |
| 2021/0025269 | A1 | 1/2021 | Zaripov | |
| 2021/0108503 | A1* | 4/2021 | Neufeldt | E21B 21/08 |
| 2022/0178248 | A1* | 6/2022 | Chambon | E21B 19/00 |
| 2023/0417134 | A1 | 12/2023 | Neufeldt et al. | |

FOREIGN PATENT DOCUMENTS

| | | |
|---|---|---|
| CA | 2582365 | 4/2006 |
| CA | 2636249 | 8/2007 |
| CA | 2700258 | 3/2009 |
| CA | 2921163 | 4/2015 |
| CA | 2938521 | 9/2015 |

OTHER PUBLICATIONS

Well Engineers Notebook, Feb. 1998, 4th Edition, May 2003, Shell International Exploration And Production B.V., Ep Learning And Development.

* cited by examiner

CONTROLLING DRILLING OF A WELLBORE BASED ON UPDATED BIT DEPTH

FIELD OF THE DISCLOSURE

The present disclosure relates to downhole drilling and in particular to methods, systems, and computer-readable media for controlling drilling of a wellbore based on updated bit depth.

BACKGROUND TO THE DISCLOSURE

During oil and gas drilling, a drill bit located at the end of a drill string is rotated into and through a formation to drill a wellbore. One form of drilling is directional drilling, in which the drill string has a slight bend near its distal end. During directional drilling, it is common practice to alternate between sliding and rotating. When sliding, the drill string is rotated to a particular orientation, and then drilling proceeds with the drill string maintained in this constant orientation, allowing the driller to alter the direction of the wellbore via the bend in the drill string. When rotating, the entire drill string is rotated, allowing the driller to drill forward in a straight line from the last slide. The driller alternates between rotating and sliding, to steer the wellbore as desired.

Bit depth (i.e., the current depth of the drill bit) and hole depth (i.e., the current depth of the wellbore) are tracked during drilling. These drilling parameters are important because they allow the driller to know whether the drill bit is off-bottom or on-bottom (i.e., in contact with the formation). Errors in both recorded bit and/or hole depth can potentially lead to the driller misjudging whether the bit is on-bottom and when the bit will hit bottom, which can lead to unnecessary adjustments, equipment damage, or poor well trajectory.

SUMMARY OF THE DISCLOSURE

According to a first aspect of the disclosure, there is provided a method of using one or more computer processors to control drilling of a wellbore, comprising: determining a current bit depth indicative of a depth of a drill bit being used to drill the wellbore; determining a compression factor indicative of compression of a drill string to which is attached the drill bit; updating, based on the current bit depth and the compression factor, the current bit depth; and controlling the drilling of the wellbore based on the updated bit depth.

The drilling may be controlled by an automated drilling unit that: receives one or more drilling parameter inputs; and outputs, based on the one or more drilling parameter inputs, one or more drilling parameter setpoints that are used to control the drilling of the wellbore. Controlling the drilling of the wellbore may comprise: inputting the one or more drilling parameter inputs, including the updated bit depth, to the automated drilling unit; receiving, from the automated drilling unit, the one or more drilling parameter setpoints; and controlling drilling of the wellbore based on the one or more drilling parameter setpoints.

Controlling the drilling of the wellbore may comprise performing, when the drill bit is off-bottom, a first toolface control operation comprising rotating the drill string by an amount of rotation that is based on the updated bit depth.

The method may further comprise, after performing the first toolface control operation: determining that a touchdown condition has been met; and in response to determining that the touchdown condition has been met, performing a second toolface control operation comprising further rotating the drill string by an amount of rotation that is based on the updated bit depth.

Determining that the touchdown condition has been met may comprise: monitoring a differential pressure across the drill bit; and determining, based on the differential pressure, that the touchdown condition has been met.

Updating the current bit depth may comprise: when the drill bit is off-bottom, calculating: bitDepth[i]=bitDepth[i−1]−(blockHeight[i]−blockHeight[i−1])+(hookload[i]−hookload[i−1])*AxComp, wherein bitDepth[i] is the current bit depth, bitDepth[i−1] is a previous bit depth, blockHeight[i] is a current block height of a travelling block connected to the drill string, blockHeight[i−1] is a previous block height of the travelling block, hookload[i] is a current hookload reading, hookload[i−1] is a previous hookload reading, and AxComp is the compression factor.

Updating the current bit depth may further comprise: determining a current hole depth indicative of a depth of the wellbore; and before calculating bitDepth[i], determining that the drill bit is off-bottom by determining that the current bit depth is greater than or equal to the current hole depth.

Determining the compression factor may comprise determining the compression factor based on dimensions of the drill string and Young's modulus of one or more materials comprised in the drill string.

Determining the compression factor may comprise: determining a change in block height of the travelling block; determining a change in hookload; and determining the compression factor by calculating the change in block height divided by the change in hookload.

The method may further comprise: determining hole depth indicative of a depth of the wellbore; and determining, based on the hole depth and the updated bit depth, an updated off-bottom distance. Controlling the drilling of wellbore may be based on the updated off-bottom distance.

Controlling the drilling of wellbore may comprise: performing, when the drill bit is off-bottom, a toolface control operation comprising rotating the drill string by an amount of rotation that is based on the updated off-bottom distance.

The method may further comprise: determining a current hole depth indicative of a depth of the wellbore; determining that the updated bit depth is greater than the current hole depth; and in response to determining that the updated bit depth is greater than the current hole depth, setting the current hole depth equal to the updated bit depth.

The method may further, prior to setting the current hole depth equal to the updated bit depth, determining one or any combination of the following: that the drill string is not currently in-slips; that a current weight-on-bit, indicative of a weight applied to the drill bit, is greater than a minimum weight-on-bit; that a pump rate, indicative of a rate at which a mud pump is operating, is greater than a minimum pump rate; and that the last direction in which a travelling block, connected to the drill string, moved is down.

Determining that the last direction in which the travelling block moved is down may comprise calculating: blockHeightDiff=blockHeight[t]−blockHeight[t−1] and lastBlocksDown[t]=blockHeightDiff<0.0 or (blockHeightDiff==0.0 and lastBlocksDown[t−1]), wherein blockHeight[t] is a current block height of the travelling block, blockHeight[t−1] is a previous block height of the travelling block, lastBlocksDown[t] is the last direction in which the travelling block moved, and lastBlocksDown[t−1] is the last direction in which the travelling block moved at a point in time prior to lastBlocksDown[t].

Updating the current bit depth may comprise: when the drill string is in-slips, calculating: bitDepth[i]=bitDepth[i−1]+(hookload[i]−hookload[i−1])*AxComp, wherein bitDepth[i] is the current bit depth, bitDepth[i−1] is a previous bit depth, hookload[i] is a current hookload reading, hookload[i−1] is a previous hookload reading, and AxComp is the compression factor.

Determining the compression factor may comprise determining the compression factor based on dimensions of the drill string and Young's modulus of one or more materials comprised in the drill string.

Determining the compression factor may comprise: determining a change in block height of the travelling block; determining a change in hookload; and determining the compression factor by calculating the change in block height divided by the change in hookload.

Updating the current bit depth may further comprise, before calculating bitDepth[i], determining that the drill string is in-slips by determining that the current hookload reading is less than threshold.

Updating the current bit depth may further comprise, when the drill string is transitioning from in-slips to out-of-slips, calculating: bitDepth[i]=bitDepth[i−1]+(hookload[i]−hookload [i−1]−hookloadComp)*AxComp, wherein hookloadComp is indicative of an expected change in hookload that is unconnected to compression of the drill string.

According to a first aspect of the disclosure, there is provided a non-transitory computer-readable medium having stored thereon computer program code configured when executed by one or more processors to cause the one or more processors to perform a method of controlling drilling of a wellbore, comprising: determining a current bit depth indicative of a depth of a drill bit being used to drill the wellbore; determining a compression factor indicative of compression of a drill string to which is attached the drill bit; updating, based on the current bit depth and the compression factor, the current bit depth; and controlling the drilling of the wellbore based on the updated bit depth.

According to a first aspect of the disclosure, there is provided a drilling rig comprising: a drill string having a drill bit at end thereof for drilling a wellbore; one or more sensors for measuring block height and hookload, wherein block height is indicative of a height of a travelling block connected to the drill string, and hookload is indicative of a load exerted by the drill string; and one or more processors configured to receive as inputs real-time measurements of the block height and the hookload obtained by the one or more sensors during drilling of the wellbore, and configured to: determine a current bit depth indicative of a depth of the drill bit during drilling of the wellbore; determine a compression factor indicative of compression of the drill string drilling of the wellbore; update, based on the current bit depth and the compression factor, the current bit depth; and control the drilling of the wellbore based on the updated bit depth.

This summary does not necessarily describe the entire scope of all aspects. Other aspects, features, and advantages will be apparent to those of ordinary skill in the art upon review of the following description of specific embodiments.

BRIEF DESCRIPTION OF THE DRAWINGS

Embodiments of the disclosure will now be described in detail in conjunction with the accompanying drawings of which.

DETAILED DESCRIPTION

Figure 1:
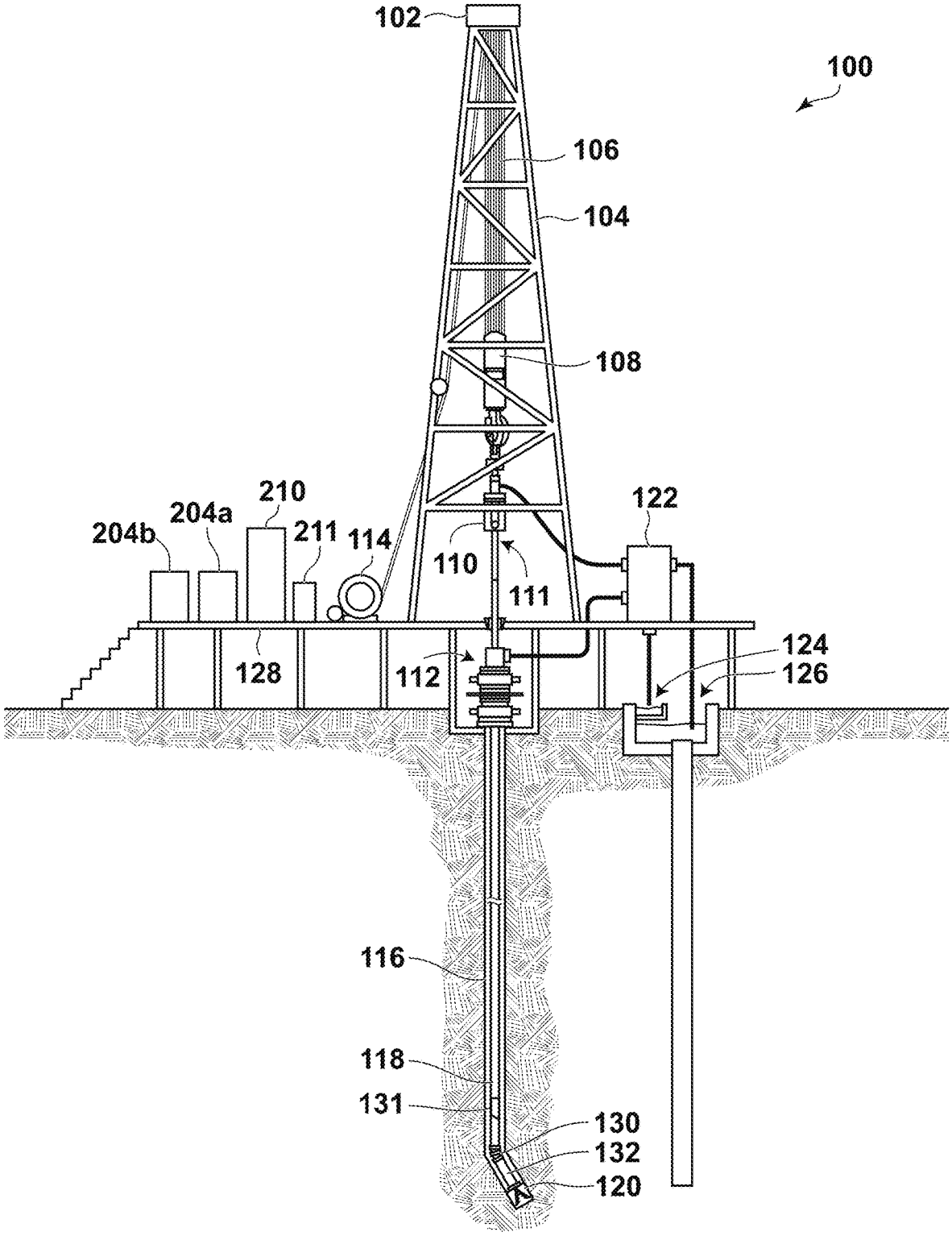
FIG. 1 is a schematic diagram of a drilling rig, according to an embodiment of the disclosure.

The present disclosure seeks to provide methods, systems, and computer-readable media for controlling drilling of a wellbore based on updated bit depth. While various embodiments of the disclosure are described below, the disclosure is not limited to these embodiments, and variations of these embodiments may fall within the scope of the disclosure which is to be limited only by the appended claims.

Generally, when tracking bit depth and hole depth, it is assumed that the drill string is completely stiff, and that a change in block height equates to an equal change in bit depth. However, given the weight applied to the drill string, for some hole conditions the drill string can experience a large amount of stretch/compression (e.g., up to a meter or more). The amount of error can vary based on one or more different conditions, such as:

- whether the rig pulled off bottom immediately at the end of the stand, or whether the drawworks was simply stopped and the drill string was allowed to "drill-off";
- when the rig was last on-bottom, whether the drill string was rotating or sliding (the amount of pipe compression/stretch is very different in these two scenarios); and
- when the rig is currently going to bottom, whether the drill string is rotating, oscillating, or sliding.

Embodiments of the disclosure are therefore aimed at updating bit depth and hole depth to take into account compression/stretching of the drill string under various conditions.

Embodiments of the disclosure include methods of using one or more computer processors to control drilling of a wellbore. A current bit depth indicative of a depth of a drill bit being used to drill the wellbore is determined. A compression factor indicative of compression of a drill string to which is attached the drill bit is determined. Based on the current bit depth and the compression factor, the current bit depth is updated. The drilling of the wellbore is then controlled based on the updated bit depth.

According to some embodiments, a current hole depth indicative of a depth of the wellbore is also determined. If the updated bit depth is greater than the current hole depth, then the current hole depth is set to be equal to the updated bit depth.

Controlling the drilling of the wellbore may comprise performing, when the drill bit is off-bottom, a first toolface control operation in which the drill string is rotated by an amount of rotation that is based on the updated bit depth. The amount of rotation may be additionally based on the updated hole depth. In particular, the amount of rotation may be based on the off-bottom distance which is the distance separating the drill bit from the bottom of the wellbore (i.e., off-bottom distance=hole depth-bit depth). According to some embodiments, after performing the first toolface control operation, the one or more computer processors may determine that a touchdown condition has been met (e.g., that the drill bit has contacted the formation). In response to determining that the touchdown condition has been met, a second toolface control operation may be performed, in which the drill string is further rotated by an amount of rotation that is based on the updated bit depth, or the off-bottom distance which is calculated based on the updated bit depth and the updated hole depth.

As described in further detail below, accurately knowing the off-bottom distance may be important when applying reactive turns to the drill string (and in particular, how many reactive turns) when the drill bit is being moved into contact with the formation.

Various embodiments of the disclosure will now be described with reference to the drawings.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a travelling block 108 via a crown block 102. The travelling block 108 is connected to the drill string 118 via a top drive 110. The top drive 110 is connected to the drill string 118 by a tubular section known as a quill 111. Rotating the drawworks 114 consequently is able to change weight-on-bit (WOB) during drilling, with rotation in one direction lifting the travelling block 108 and generally reducing WOB and rotation in the opposite direction lowering the travelling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Up-hole of the bent sub 130 is located a measurement-while-drilling (MWD) tool 131. MWD tool 131 collects and transmits data from inside the wellbore 116, such as formation properties, rotational speed, vibration, temperature, torque, pressure, and mud flow. The MWD tool 131 measures the inclination, azimuth, and toolface orientation of a downhole tool near the drill bit 120. Toolface orientation (or simply "toolface") combined with inclination, azimuth, and the geometry of the bottom hole assembly can be used to determine the trajectory of the drill string 118.

The MWD data may be transferred to the surface using any of various means, such as mud pulse telemetry, electromagnetic telemetry (generally for relatively shallow depths), acoustic telemetry, or a wired drill pipe. The MWD data is decoded at the surface by an MWD decoder 211. Generally, the decoded MWD data is sent to a directional driller's workstation and doghouse computer (see below).

Figure 2:
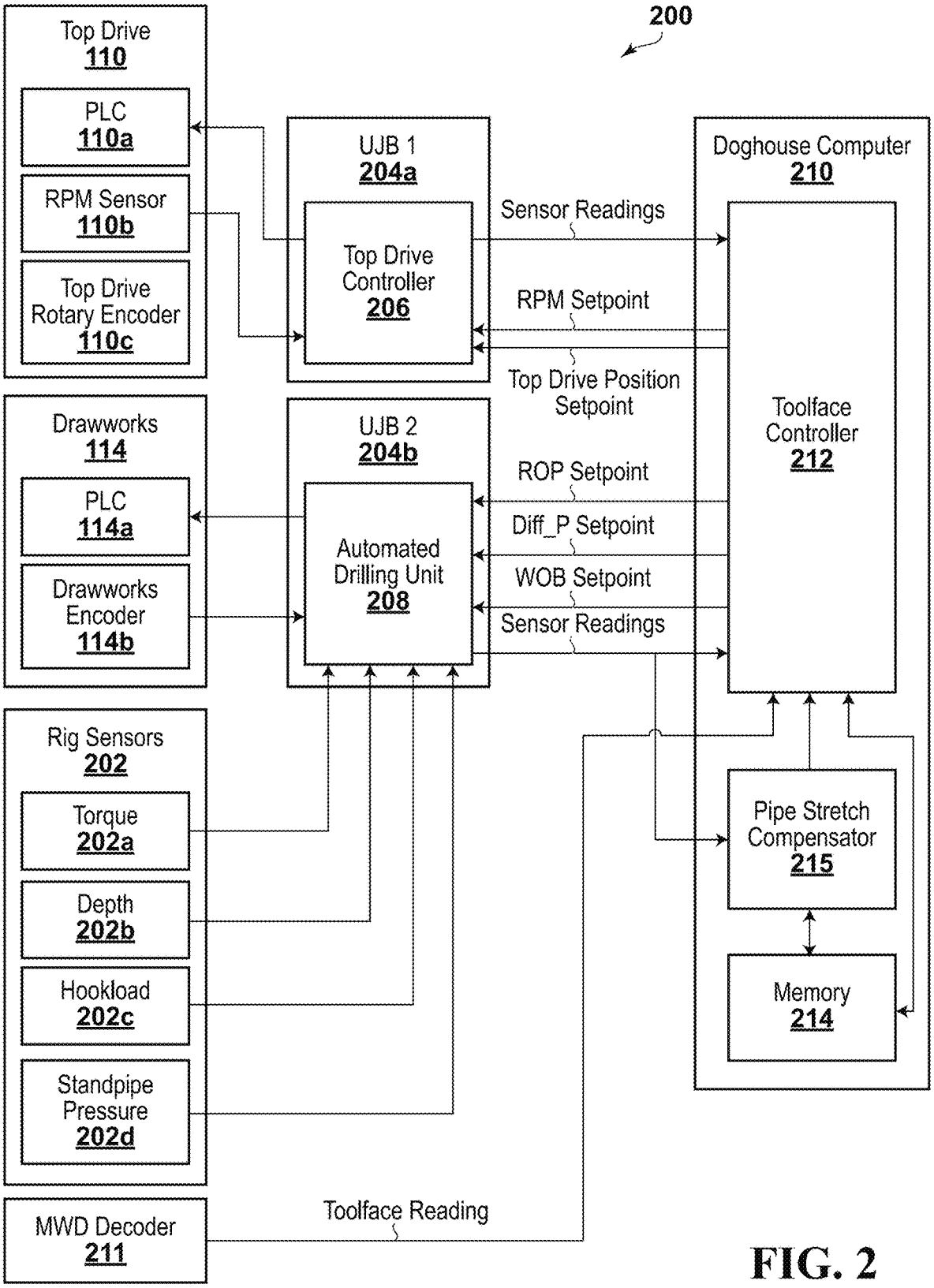
FIG. 2 is a first block diagram of a system for performing automated drilling of a wellbore, according to an embodiment of the disclosure.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the travelling block 108. The top drive 110 comprises a top drive programmable logic controller ("top drive PLC") 110*a* that controls the top drive's 114 rotation and a revolutions-per-minute (RPM) sensor 110*b* that outputs the rotational rate of the drill string 118. More generally, the top drive PLC 110*a* is an example of a rotational drive unit controller and the RPM sensor 110*b* is an example of a rotation rate sensor. In addition, top drive 110 further includes a top drive rotary encoder 110*c* (mounted within or externally to the top drive 110). Top drive rotary encoder 110*c* is used to measure the angle of rotation of quill 111. Top drive rotary encoder 110*c* is an example of a rotational position sensor and is used to provide a feedback signal for controlling the toolface of the downhole tool, as described in further detail below.

A first junction box 204*a* houses a top drive controller 206, which is communicatively coupled to the top drive PLC 110*a*, the RPM sensor 110*b*, and the top drive rotary encoder 110*c*. The top drive controller 206 controls the rotation rate of the drill string 118 by instructing the top drive PLC 110*a* and obtains the rotational position, rate of rotation, and direction of rotation of the drill string 118 from top drive rotary encoder 110*c*.

A second junction box 204*b* houses an automated drilling unit 208 (or simply "automatic driller 208"), which is communicatively coupled to the drawworks PLC 114*a* and the drawworks encoder 114*b*. The automated drilling unit 208 modulates WOB during drilling by instructing the drawworks PLC 114*a* and obtains the height of the travelling block 108 from the drawworks encoder 114*b*. In different embodiments, the height of the travelling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the rate of penetration (ROP) of the drill bit 120 by monitoring the height of the travelling block 108 over time.

The system 200 also comprises a doghouse computer 210. The doghouse computer 210 comprises a toolface controller 212, a pipe stretch compensator 215, and memory 214 communicatively coupled to each other. The memory 214 stores on it computer program code that is executable by the toolface controller 212 and that, when executed, causes the toolface controller 212 to perform methods for performing automated drilling of the wellbore 116. In particular, the toolface controller 212 may perform methods for controlling a toolface of the downhole tool, such as those described in U.S. Pat. No. 11,549,357 B2, incorporated herein by reference in its entirety. The toolface controller 212 receives readings from the RPM sensor 110*b*, drawworks encoder 114*b*, top drive rotary encoder 110*c*, and the rig sensors 202. MWD decoder 211, having received a toolface reading from downhole MWD tool 131, transmits the toolface reading directly to toolface controller 212. Pipe stretch compensator 215 also receives sensor readings from automated drilling unit 208, and communicates updated bit depth and hole depth readings to toolface controller 212, as described in further detail below. According to some embodiments, pipe stretch compensator 215 does not need to receive sensor readings from automated drilling unit 208, and may instead receive the sensor readings some other way (for example, directly from rig sensors 202 themselves).

The toolface controller 212 sends one or more of an ROP setpoint, a differential pressure setpoint, and a WOB setpoint to the automated drilling unit 208, and one or more of an RPM setpoint and a top drive position setpoint to the top drive controller 206. The top drive position setpoint may include a rotational position setpoint of the top drive 110 (indicative of a desired rotational position of the top drive 110), or a rotational position setpoint indicative of a target midpoint about which the top drive 110 is oscillated (or a target neutral point in the case of asymmetric oscillations). The top drive controller 206 and automated drilling unit 208 relay these setpoints to the top drive PLC 110*a* and drawworks PLC 114*a*, respectively, where they are used for automated drilling.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 206, automated drilling unit 208, and doghouse computer 210 are respective example types of drilling controllers. In the system 200 of FIG. 2, the top drive controller 206206 and the automated drilling unit 208 are distinct and respectively use the RPM and top drive position setpoints, and the WOB, differential pressure, and ROP setpoints, for automated drilling. However, in different embodiments (not depicted), the functionality of the top drive controller 206 and automated drilling unit 208 may be combined or may be divided between three or more controllers. In certain embodiments (not depicted), the toolface controller 212 may directly communicate with any one or more of the top drive 110, drawworks 114, sensors 202, and MWD decoder 211. Additionally or alternatively, in different embodiments (not depicted) automated drilling may be done in response to only the RPM setpoint, only the ROP setpoint, only the WOB setpoint, only the differential pressure setpoint, only the top drive position setpoint, or any combination thereof, possibly in combination with one or more other drilling parameters. Examples of these additional drilling parameters comprise, for example, depth of cut, torque, and flow rate (into the wellbore 116, out of the wellbore 116, or both).

In the depicted embodiments, the top drive controller 206 and the automated drilling unit 208 acquire data from the sensors 202 discretely in time at a sampling frequency F_s, and this is also the rate at which the doghouse computer 210 acquires the sampled data. Accordingly, for a given period T, N samples are acquired with N=TF_s. In different embodiments (not depicted), the doghouse computer 210 may receive the data at a different rate than that at which it is sampled from the sensors 202. Additionally or alternatively, the top drive controller 206 and the automated drilling unit 208 may sample data at different rates, and more generally in embodiments in which different equipment is used data may be sampled from different sensors 202 at different rates.

Figure 3:
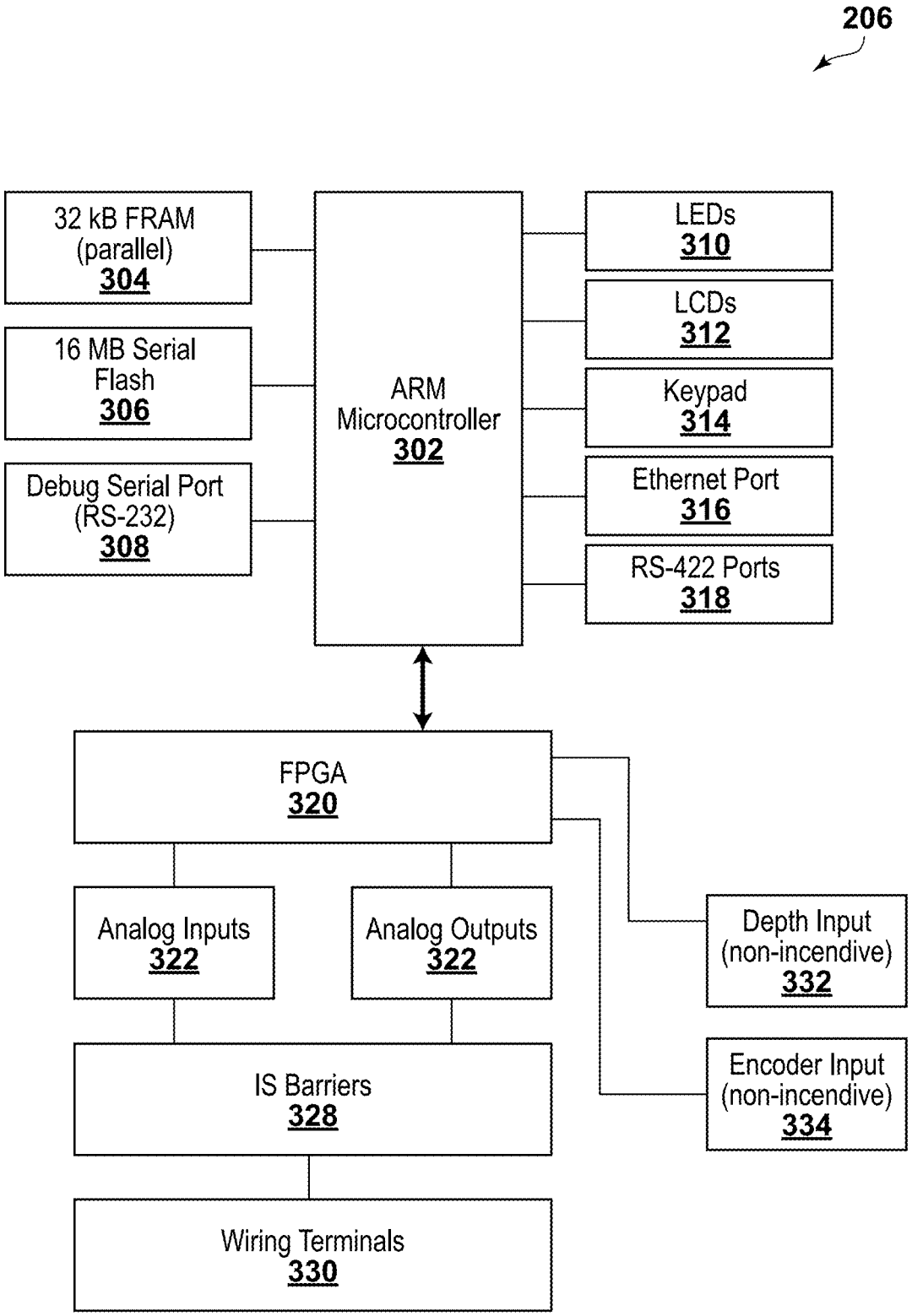
FIG. 3 is a second block diagram of a system for performing automated drilling of a wellbore, according to an embodiment of the disclosure.

Referring now to FIG. 3, there is shown a hardware block diagram 300 of the second junction box 204*b* of FIG. 2. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automatic driller 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automatic driller 208 outputs a throttle signal to a PLC using an analog output. According to some embodiments, automatic driller 208 communicates with a band brake controller using an RS-422 port.

The FPGA 320 is also communicatively coupled to a non-incendive depth input 332 and a non-incendive encoder input 334. In different embodiments (not depicted), the automatic driller 208 may receive different sensor readings in addition to or as an alternative to the readings obtained using the depicted sensors 202*a*,202*b*,202*c*,202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
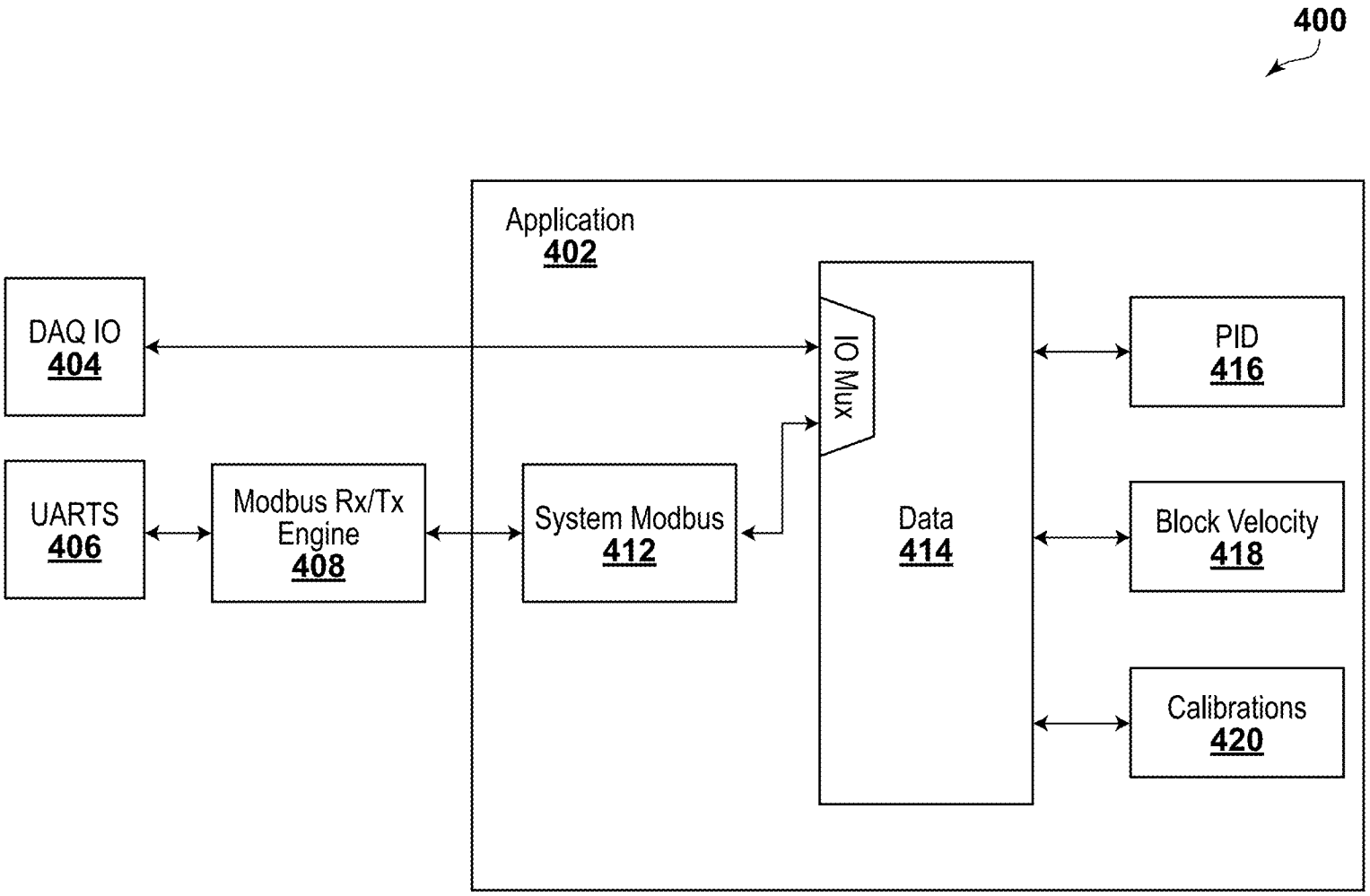
FIG. 4 is a block diagram of the automated drilling unit of FIGS. 2 and 3, according to an embodiment of the disclosure.

Referring now to FIG. 4, there is shown a block diagram of software modules, some of which comprise a software application 402, running on the automatic driller of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the travelling block 108 from the travelling block height derived using measurements from the block height sensor. The microcontroller 302 uses the calibrations module 420 to convert the electrical signals received from the sensors 202*a*,202*b*,202*c*,202*d* into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

During drilling, a reactive torque is produced by the mud motor 132 that may cause the toolface to rotate to the left. Differential pressure may be used as a proxy for reactive torque. Differential pressure is roughly the difference between on- and off-bottom standpipe pressure which may be a proxy for the pressure loss across the mud motor 132.

Figure 5:
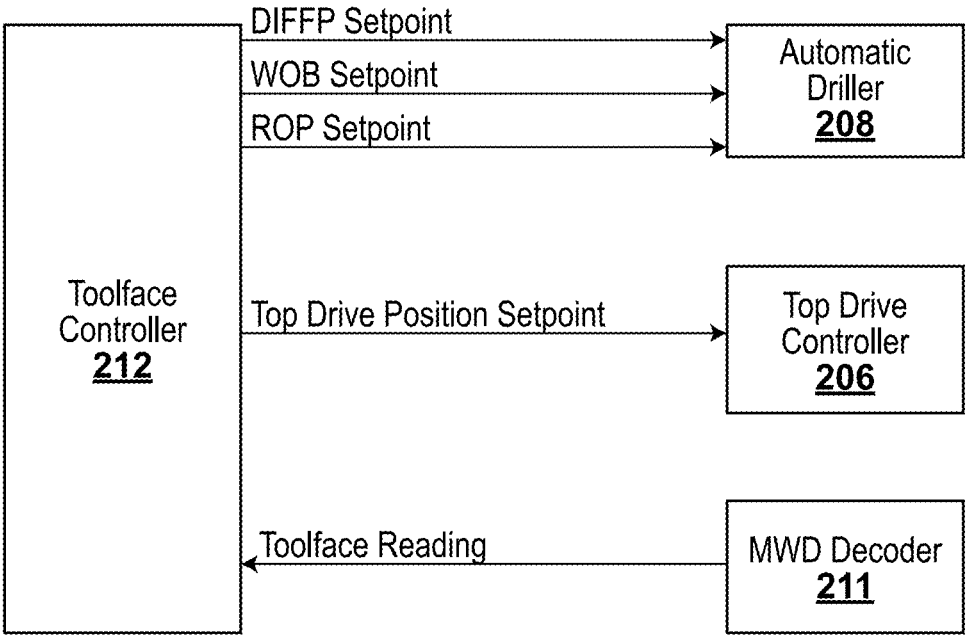
FIG. 5 is a block diagram of software modules running on the automated drilling unit of FIGS. 2 and 3, according to an embodiment of the disclosure.

Turning to FIG. 5, there is shown a block diagram of toolface controller 212 interacting with automatic driller 208, top drive controller 206, and MWD decoder 211. Toolface controller 212 determines, depending on the desired toolface correction, adjustments to one or more drilling parameter setpoints, and inputs the adjusted drilling parameter setpoint(s) to automatic driller 208 and/or top drive controller 206 to correct the toolface of the downhole tool, e.g. by minimizing a difference between a measured toolface and the toolface setpoint (e.g. a desired toolface).

As described above, top drive controller 206 manages the rotation of drill string 118, controls the oscillation of drill string 118, and effects changes to the rotational position of top drive 110. When performing rotational drilling, top drive controller 206 rotates drill string 118 constantly in the same direction (e.g. to the right). When sliding, in order to maintain toolface control, top drive controller 206 provides changes to one or more of a rotational position of the top drive 110 and a midpoint (or neutral point) about which the top drive 110 is oscillated. Generally, when sliding in the lateral, top drive controller 206 oscillates the top of drill string 118 a set amount in each direction. This reduces friction along drill string 118 and allows for smoother sliding. The amount of oscillation is chosen to allow most of drill string 118 to have some rotation without this rotation reaching the downhole tool. Changes to the midpoint or neutral point of this oscillation will propagate to the toolface over time. While oscillation can be used during vertical drilling and in the build, it is generally more often used while drilling in the lateral.

MWD decoder 211 receives from MWD tool 131 encoded data relating the toolface of the downhole tool (e.g. every 30 seconds, for example). MWD decoder 211 may decode the data to determine the current toolface and provides the toolface reading to toolface controller 212. MWD decoding can be performed through a variety of means, depending on how the data is sent. If the data is transmitted using mud-pulse telemetry, then MWD decoder 211 uses pressure information from a pressure sensor, such as standpipe pressure sensor 202*d*, to identify signals sent through the mud. MWD decoder 211 decodes the data and sends the toolface reading to toolface controller 212. The frequency of the updates to the current toolface may depend on equipment, conditions, and depth.

Separate to ongoing toolface control, toolface controller 212 controls how and when compensation for reactive torque is introduced to the drill string 118 when drill bit 120 is going to bottom. This can occur, for example, after a connection, after switching from rotational drilling to slide drilling, when toolface control is lost and drill bit 120 is raised from the bottom to re-establish toolface control, or when toolface control is halted to allow WOB to drill off. As drill bit 120 nears the bottom of the wellbore, a first amount of the total desired rotation of drill string 118 is added by top drive controller 206, and the remainder of the total desired rotation is added after drill bit 120 touches bottom. According to some embodiments, about 80% of the total desired rotation is added before drill bit 120 touches bottom.

A previous method of determining the point at which drill bit 120 touches bottom is based on determining when bit depth is equal to hole depth. Another, more advanced method is based on a combination of differential pressure and one or more comparisons of bit depth and hole depth. Relying on differential pressure alone may only allow the user to determine whether or not the drill bit is on bottom, but it may not allow the user to determine the off-bottom distance. Since most reactive turns are introduced at a certain distance before hitting bottom, using a combination of differential pressure and one or more comparisons of bit depth and hole depth may allow the user to determine the off-bottom distance. However, as explained above, bit depth and hole depth are affected by pipe stretch, and this method of determining the off-bottom distance may be inaccurate if pipe stretch is not taken into account.

According to embodiments of the disclosure, the effect of pipe stretch on bit depth and hole depth may be eliminated from the readings of bit depth and hole depth. As such, updated values for bit depth and hole depth may be used to determine the off-bottom distance separating drill bit 120 from the formation. The off-bottom distance may therefore be calculated more accurately. As a result, point in time at which reaction turns are applied to the drill string, and/or the amount of reactive turns that are applied to the drill string before the drill bit touches bottom, may be more accurately determined.

Figure 6:
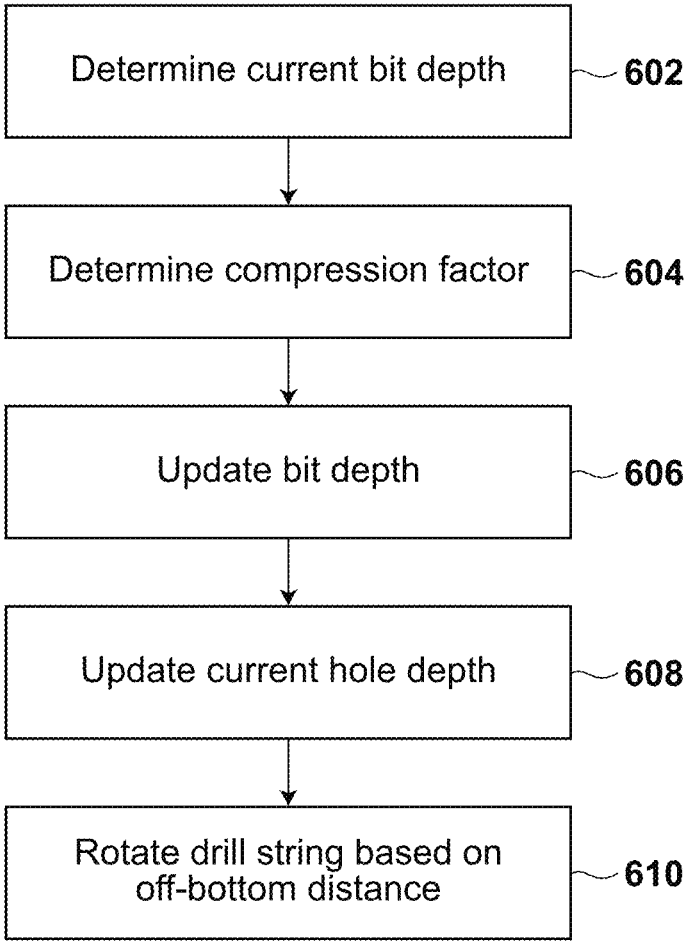
FIG. 6 is a general flow diagram of a method of controlling drilling of a wellbore based on updated bit depth and updated hole depth, according to an embodiment of the disclosure.

Turning now to FIG. 6, there is shown a flow diagram illustrating a general method of controlling drilling of a wellbore based on updated bit depth and hole depth. The operations at blocks 602-608 may be performed by pipe stretch compensator 215.

At block 602, the current bit depth of the drill bit is determined, for example using depth sensor 202*b*.

At block 604, a compression factor affecting the drill string is determined. Various methods for determining the compression factor may be used, described in further detail below.

At block 606, based on the compression factor, the current bit depth is updated.

At block 608, based on the updated bit depth, the current hole depth is updated.

At block 610, using one or both of the updated bit depth and updated hole depth, toolface controller 212 may execute one or more toolface control operations to initiate one or more reactive turns (e.g., specified amounts of rotation of the drill string) in order to compensate for reactive torque that will be experienced when the drill bit contacts the formation.

According to some embodiments of the disclosure, pipe stretch compensator 215 may perform the following steps in order to calculate updated bit depth and hole depth values to be used by toolface controller 212.

Pipe stretch compensator 215 first determines that the drill bit it on-bottom and has drilled sufficiently far (for example, at least two meters) such that the drill string is fully compressed. If these conditions have been met, the values for bit depth, hole depth, and hookload are synchronized. In particular, corrected bit and hole depth are set to the current sensor values. Pipe stretch (the determination of which is described in detail below) is then based on the change in hookload from the point in time the synchronization occurs.

For each point in time, a new bit depth is then calculated as follows:

$$bitDepth[i] = bitDepth\left[i-1\right] - \left(blockHeight[i] - blockHeight\left[i-1\right]\right) + \left(hookload[i] - hookload\left[i-1\right]\right) * AxComp$$

bitDepth is bit depth, blockHeight is the height of the traveling block, hookload is the total weight supported by the rig at the surface,[i] is the index of the current readings/values,[i−1] is the index of the previous readings/values, and AxComp is the axial compliance of the drill string.

The axial compliance may be determined using the dimensions of the drill string as well as Young's Modulus of the material making up the drill string (for example, steel or aluminium). According to some embodiments, the axial compliance may be calculated as follows:

For each element in the drill string, calculate:

$$A = \pi * \frac{\left(OD^2 - ID^2\right)}{4}$$

OD is the outside diameter of the drill string, ID is the inside diameter of the drill string, and A is the cross-sectional area of the drill string.

For a given drill string element i:

$$\lambda_i = \frac{1}{E * A} * L$$

λ is the axial compliance, E is Young's Modulus of the drill string element, and L is the length of the drill string. A typical rig may use multiple sizes of drill string, and may include tool joints. In this case, the same equations above may be used to calculate the compliance for each individual element, and are then added together:

$$\lambda_{total} = \sum \lambda_i$$

Alternatively, according to some embodiments, the axial compliance can be estimated based on:

$$AxComp = \left(blockHeight[i] - blockHeight\left[i-1\right]\right) / \left(hookload[i] - hookload\left[i-1\right]\right)$$

After calculating the updated bit depth, the updated bit depth is compared to the current hole depth. If the current hole depth has increased, then the current hole depth is set to the updated bit depth: holeDepth[i]=bitDepth[i].

Before setting the current hole depth equal the updated bit depth, one or more conditions may first be checked. In particular, pipe stretch compensator 215 may determine one or any combination of the following:

- whether the drill string is currently in-slips;
- whether a current weight-on-bit, indicative of a weight applied to the drill bit, is greater than a user-defined minimum weight-on-bit;
- whether a pump rate, indicative of a rate at which the mud pump is operating, is greater than a user-defined minimum pump rate; and
- whether the last direction in which the traveling block moved is down.

The final condition is checked because otherwise, when changing the direction of the traveling block's movement, the instantaneous change in hookload may not be representative of the stretch across the drill string. In order to determine the last direction in which the travelling block moved, pipe stretch compensator 215 may calculate:

$$blockHeightDiff = blockHeight[t] - blockHeight\left[t-1\right]$$

$$lastBlocksDown[t] = blockHeightDiff < 0.0 \text{ or } \left(blockHeightDiff == 0.0 \text{ and } lastBlocksDown\left[t-1\right]\right)$$

lastBlocksDown[t] is the last direction in which the travelling block moved. If the travelling block was stationary, the previous direction is remembered, until the travelling block moves again.

In cases where the drill string is in-slips, the current bit depth may be calculated by pipe stretch compensator 215 based on:

$$bitDepth[i] = bitDepth\left[i-1\right] + \left(hookload[i] - hookload\left[i-1\right]\right) * AxComp$$

hookload[i] is the current hookload reading (obtained, for example, from hookload sensor 202*c*), hookload[i−1] is the previous hookload reading, and AxComp is the compression factor.

In order to determine whether or not the drill string is in-slips, pipe stretch compensator 215 may determine that a current hookload reading is less than a user-defined threshold.

When the drill string is transitioning from in-slips to out-of-slips, pipe stretch compensator 215 may calculate:

$$bitDepth[i] = bitDepth\left[i-1\right] + \left(hookload[i] - hookload\left[i-1\right]\right) - hookloadComp) * AxComp,$$

In this case, hookloadComp is a constant that is indicative of an expected change in hookload that is independent of compression of the drill string. This constant is user-defined and may vary from rig to rig. Variables that change across a connection (e.g., mud umbilicals, and the added weight from a new pipe section (which is more relevant in the vertical)) are estimated and used in the user determination of hookloadComp.

When transitioning from in-slips to out-of-slips, hole depth is not updated. By monitoring bit depth when the drill string is transitioning from in-slips to out-of-slips, bit depth may be tracked based on stretch/relaxation that the drill string undergoes during the connection.

As described above, the updated readings for hole depth and bit depth are used by toolface controller 212 to calculate a more accurate off-bottom distance defined by: off-bottom distance=hole depth−bit depth. The updated bit depth is then used as the basis for determining when and/or by how much to turn the drill string when the drill string is going to bottom, in order to counteract the anticipated reactive torque experienced when the drill bit touches bottom.

FIGS. 7-10 show plots of uncorrected off-bottom distance (hole depth-bit depth), differential pressure, and corrected off-bottom distance. When off-bottom distance is at zero, the drill bit should be on-bottom, and differential pressure should start increasing. As can be observed, there is a noticeable offset between the point in time when the uncorrected off-bottom distance reaches 0 and the corrected off-bottom distance reaches 0. As can also be seen, the increase in differential pressure corresponds to the corrected off-bottom distance reaching 0.

Figure 7:
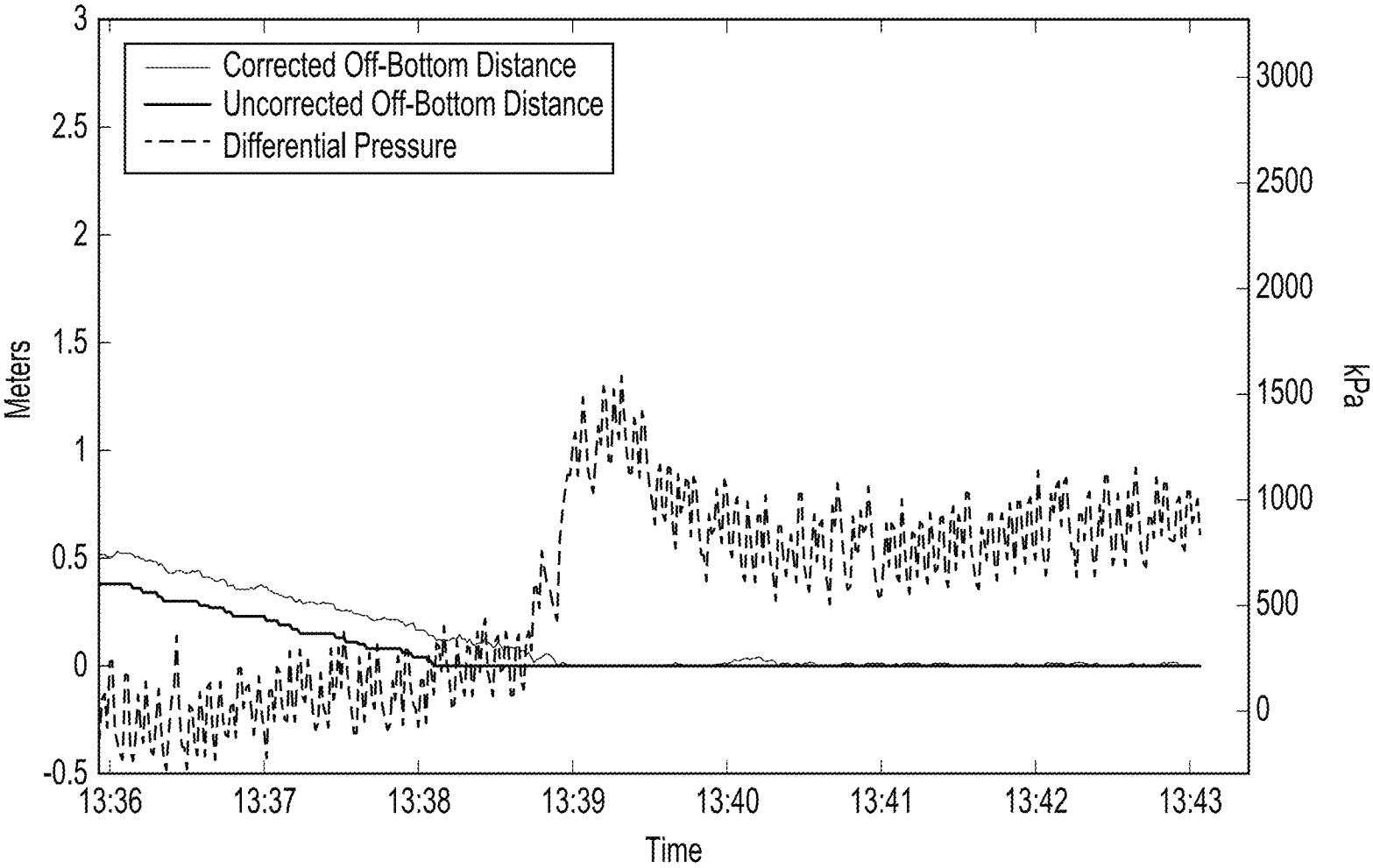
FIGS. 7-10 are plots showing uncorrected off-bottom distance, differential pressure, and corrected off-bottom distance as a function of time, according to an embodiment of the disclosure.
Figure 8:
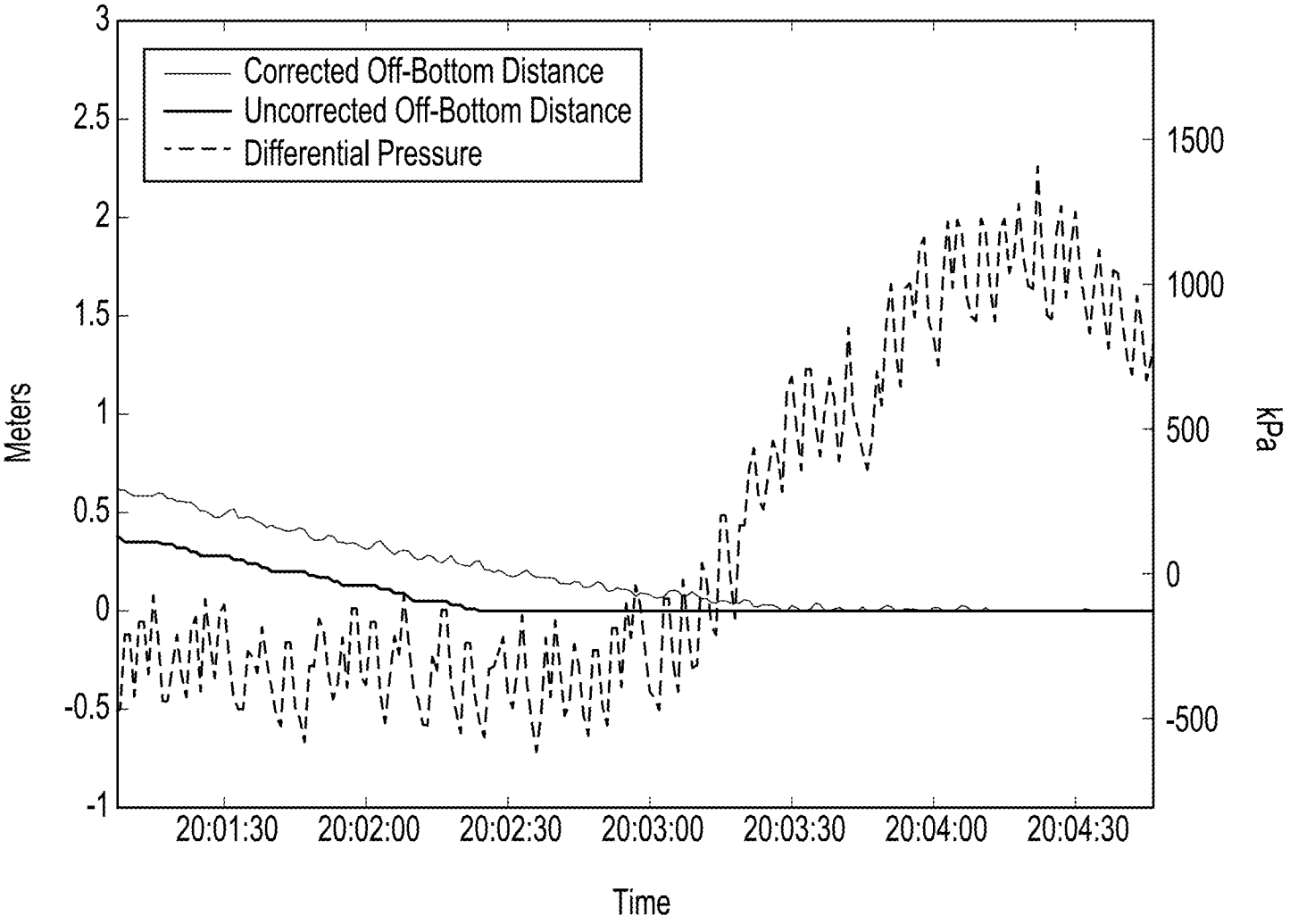
Figure 9:
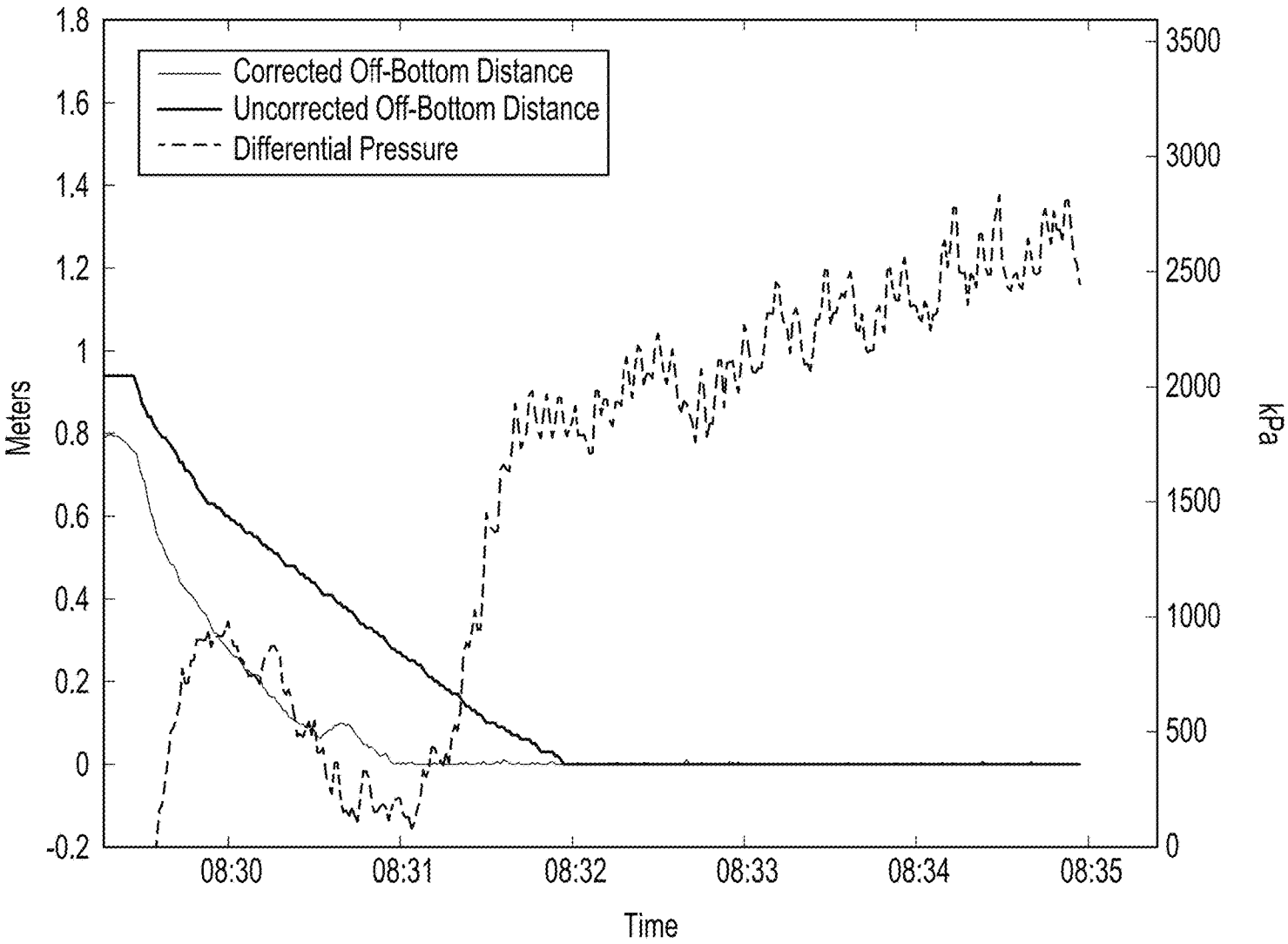
Figure 10:
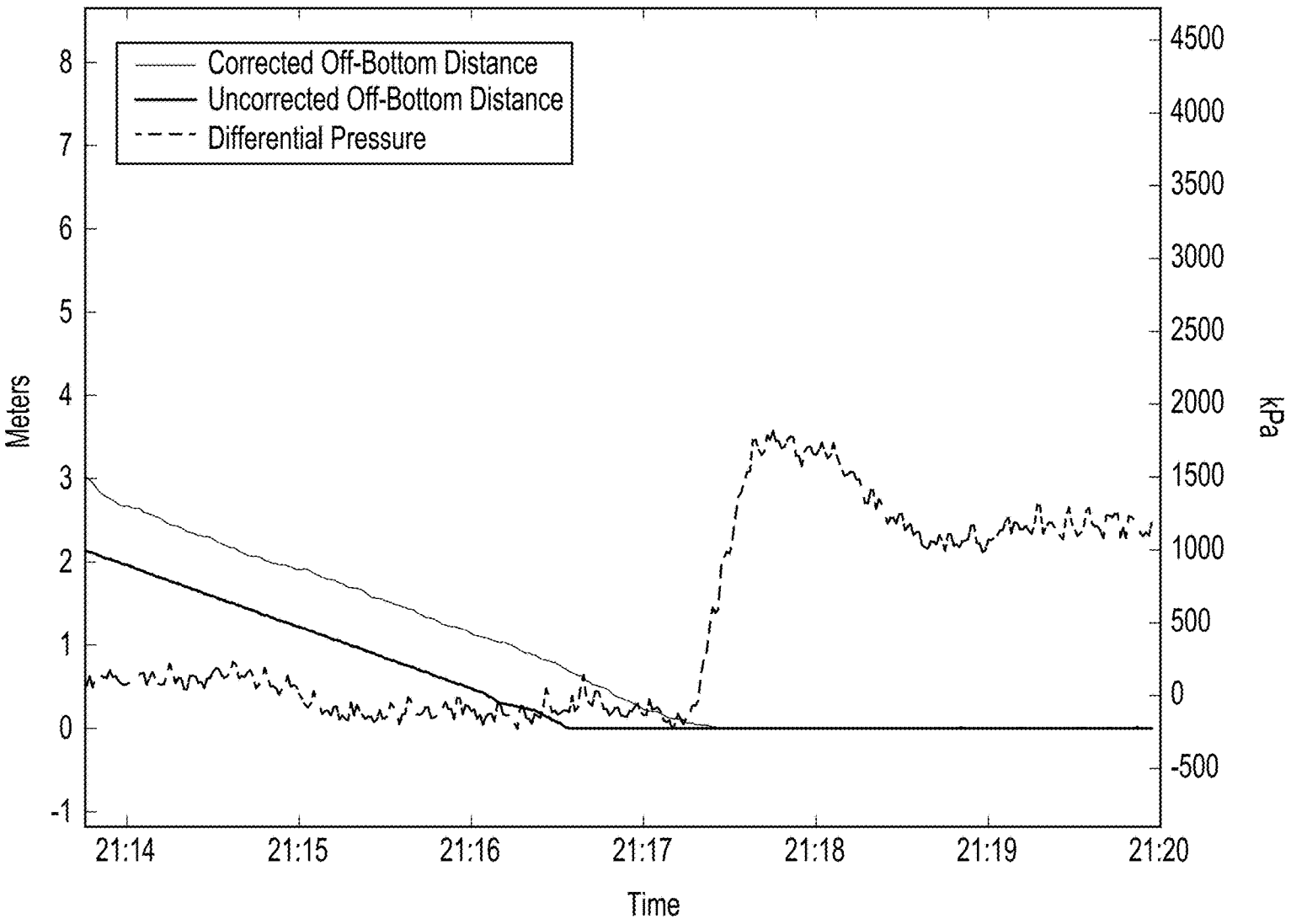

FIGS. 7 and 8 correspond to rotating to slide, while FIGS. 9 and 10 correspond to slide-to-slide. In FIGS. 9 and 10, the drill bit is pulled off bottom quickly. Note that in this case the uncorrected off-bottom distance is higher than the corrected off-bottom distance.

According to some embodiments, the updated values for bit depth and/or hole depth may be used for other applications. For example, they may be used to assist in zeroing weight-on-bit and differential pressure (corresponding to the calibration of important measurements that needs to be done when off-bottom). The updated values may also be used in rotary drilling back-to-bottom practices for mitigating dysfunction. The updated values may also be used to determine whether the bit is sufficiently lifted off the bottom when transitioning between slide, rotate, and connection modes. The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, as used herein, the terms coupled, coupling, or connected can indicate that two elements or devices are directly connected to one another or connected to one another through one or more intermediate elements or devices via a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

Use of language such as "at least one of X, Y, and Z," "at least one of X, Y, or Z," "at least one or more of X, Y, and Z," "at least one or more of X, Y, and/or Z," or "at least one of X, Y, and/or Z," is intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

The invention claimed is:

1. A method of using one or more computer processors to control drilling of a wellbore, comprising:

determining a current bit depth indicative of a depth of a drill bit being used to drill the wellbore;

determining a compression factor indicative of compression of a drill string to which is attached the drill bit;

updating, based on the current bit depth and the compression factor, the current bit depth; and controlling the drilling of the wellbore based on the updated bit depth, comprising:

performing, when the drill bit is off-bottom, a first toolface control operation comprising rotating the drill string by an amount of rotation determined using the updated bit depth.

2. The method of claim 1, wherein:

the drilling is controlled by an automated drilling unit that:

receives one or more drilling parameter inputs; and outputs, based on the one or more drilling parameter inputs, one or more drilling parameter setpoints that are used to control the drilling of the wellbore; and controlling the drilling of the wellbore comprises:

inputting the one or more drilling parameter inputs, including the updated bit depth, to the automated drilling unit;

receiving, from the automated drilling unit, the one or more drilling parameter setpoints; and controlling drilling of the wellbore based on the one or more drilling parameter setpoints.

3. The method of claim 1, further comprising, after performing the first toolface control operation:

determining that a touchdown condition has been met; and in response to determining that the touchdown condition has been met, performing a second toolface control operation comprising further rotating the drill string by an amount of rotation determined using the updated bit depth.

4. The method of claim 3, wherein determining that the touchdown condition has been met comprises:

monitoring a differential pressure across the drill bit; and determining, based on the differential pressure, that the touchdown condition has been met.

5. The method of claim 1, wherein updating the current bit depth comprises:

when the drill bit is off-bottom, calculating:

$$bitDepth[i] = bitDepth[i-1] - (blockHeight[i] - blockHeight[i-1]) + (hookload[i] - hookload[i-1]) * AxComp,$$

wherein bitDepth[i] is the current bit depth, bitDepth[i−1] is a previous bit depth, blockHeight[i] is a current block height of a travelling block connected to the drill string, blockHeight[i−1] is a previous block height of the travelling block, hookload[i] is a current hookload reading, hookload[i−1] is a previous hookload reading, and AxComp is the compression factor.

6. The method of claim 5, wherein updating the current bit depth further comprises:

determining a current hole depth indicative of a depth of the wellbore; and before calculating bitDepth[i], determining that the drill bit is off-bottom by determining that the current bit depth is less than the current hole depth.

7. The method of claim 5, wherein determining the compression factor comprises determining the compression factor based on dimensions of the drill string and Young's modulus of one or more materials comprised in the drill string.

8. The method of claim 5, wherein determining the compression factor comprises:

determining a change in block height of the travelling block;

determining a change in hookload; and determining the compression factor by calculating the change in block height divided by the change in hookload.

9. The method of claim 1, wherein:

the method further comprises:

determining hole depth indicative of a depth of the wellbore; and determining, based on the hole depth and the updated bit depth, an updated off-bottom distance; and controlling the drilling of wellbore is based on the updated off-bottom distance.

10. The method of claim 9, wherein the amount of rotation by which the drill string is rotated according to the first toolface control operation is determined using the updated off-bottom distance.

11. The method of claim 1, further comprising:

determining a current hole depth indicative of a depth of the wellbore;

determining that the updated bit depth is greater than the current hole depth; and in response to determining that the updated bit depth is greater than the current hole depth, setting the current hole depth equal to the updated bit depth.

12. The method of claim 11, further comprising, prior to setting the current hole depth equal to the updated bit depth, determining one or any combination of the following:

that the drill string is not currently in-slips;

that a current weight-on-bit, indicative of a weight applied to the drill bit, is greater than a minimum weight-on-bit;

that a pump rate, indicative of a rate at which a mud pump is operating, is greater than a minimum pump rate; and that the last direction in which a travelling block, connected to the drill string, moved is down.

13. The method of claim 12, wherein determining that the last direction in which the travelling block moved is down comprises calculating:

$$blockHeightDiff = blockHeight[t] - blockHeight[t-1]$$

$$lastBlocksDown[t] = blockHeightDiff < 0.0 \text{ or } (blockHeightDiff == 0.0 \text{ and } lastBlocksDown[t-1]),$$

wherein blockHeight[t] is a current block height of the travelling block, blockHeight[t−1] is a previous block height of the travelling block, lastBlocksDown[t] is the last direction in which the travelling block moved, and lastBlocksDown[t−1] is the last direction in which the travelling block moved at a point in time prior to lastBlocksDown[t].

14. The method of claim 1, wherein updating the current bit depth comprises:

when the drill string is in-slips, calculating:

$$bitDepth[i] = bitDepth[i-1] + (hookload[i] - hookload[i-1]) * AxComp,$$

wherein bitDepth[i] is the current bit depth, bitDepth[i−1] is a previous bit depth, hookload[i] is a current hookload reading, hookload[i−1] is a previous hookload reading, and AxComp is the compression factor.

15. The method of claim 14, wherein determining the compression factor comprises determining the compression factor based on dimensions of the drill string and Young's modulus of one or more materials comprised in the drill string.

16. The method of claim 14, wherein determining the compression factor comprises:

determining a change in block height of the travelling block;

determining a change in hookload; and determining the compression factor by calculating the change in block height divided by the change in hookload.

17. The method of claim 14, wherein updating the current bit depth further comprises:

before calculating bitDepth[i], determining that the drill string is in-slips by determining that the current hookload reading is less than threshold.

18. The method of claim 14, wherein updating the current bit depth comprises further comprises:

when the drill string is transitioning from in-slips to out-of-slips, calculating:

$$bitDepth[i] = bitDepth[i-1] + (hookload[i] - hookload[i-1]) - hookloadComp) * AxComp,$$

wherein hookloadComp is indicative of an expected change in hookload that is unconnected to compression of the drill string.

19. A non-transitory computer-readable medium having stored thereon computer program code configured when executed by one or more processors to cause the one or more processors to perform a method of controlling drilling of a wellbore, comprising:

determining a current bit depth indicative of a depth of a drill bit being used to drill the wellbore;

determining a compression factor indicative of compression of a drill string to which is attached the drill bit;

updating, based on the current bit depth and the compression factor, the current bit depth; and controlling the drilling of the wellbore based on the updated bit depth, comprising:

performing, when the drill bit is off-bottom, a first toolface control operation comprising rotating the drill string by an amount of rotation determined using the updated bit depth.

20. A drilling rig comprising:

a drill string having a drill bit at end thereof for drilling a wellbore;

one or more sensors for measuring block height and hookload, wherein block height is indicative of a height of a travelling block connected to the drill string, and hookload is indicative of a load exerted by the drill string; and one or more processors configured to receive as inputs real-time measurements of the block height and the hookload obtained by the one or more sensors during drilling of the wellbore, and configured to:

determine a current bit depth indicative of a depth of the drill bit during drilling of the wellbore;

determine a compression factor indicative of compression of the drill string drilling of the wellbore;

update, based on the current bit depth and the compression factor, the current bit depth; and control the drilling of the wellbore based on the updated bit depth, wherein controlling the drilling of the wellbore comprises:

performing, when the drill bit is off-bottom, a first toolface control operation comprising rotating the drill string by an amount of rotation determined using the updated bit depth.

* * * * *